United States Patent [19]

Peterson

[11] Patent Number: 4,885,851

[45] Date of Patent: Dec. 12, 1989

[54] SHOESOLE FOR GOLF SHOE

[75] Inventor: William R. Peterson, Braintree, Mass.

[73] Assignee: Tretorn AB, Helsingborg, Sweden

[21] Appl. No.: 139,857

[22] Filed: Dec. 30, 1987

[51] Int. Cl.[4] ..... A43B 5/00; A43C 15/00

[52] U.S. Cl. ..... 36/127; 36/59 R; 36/67 A; 36/134

[58] Field of Search ..... 36/127, 134, 67 R, 67 A, 36/67 D, 59 R, 59 A, 59 B, 59 C, 83

[56] References Cited

U.S. PATENT DOCUMENTS

| | | | |
|---|---|---|---|
| 1,243,209 | 10/1917 | Park . | |
| 1,870,751 | 8/1932 | Reach . | |
| 3,486,249 | 12/1969 | Bernier et al. . | |
| 3,492,744 | 2/1970 | Bernier et al. . | |
| 3,619,916 | 11/1971 | Neri . | |
| 3,849,915 | 11/1974 | Inohara | 36/59 C |
| 3,988,840 | 11/1976 | Minihane . | |
| 4,067,123 | 1/1978 | Minihane . | |
| 4,133,118 | 1/1979 | Klalsa et al. | 36/83 |
| 4,167,071 | 9/1979 | Koransky | 36/127 |
| 4,178,702 | 12/1979 | Mayer | 36/127 |
| 4,184,272 | 1/1980 | Riggs . | |
| 4,327,503 | 5/1982 | Johnson . | |
| 4,335,529 | 6/1982 | Badalamenti . | |
| 4,367,600 | 1/1983 | Cross, III. et al. | 36/127 |
| 4,524,531 | 6/1985 | VanDeripe | 36/127 |
| 4,527,345 | 7/1985 | Lopez . | |
| 4,559,724 | 12/1985 | Norton . | |
| 4,590,693 | 5/1986 | Kawashima et al. | 36/134 X |
| 4,641,438 | 2/1987 | Laird et al. . | |
| 4,782,604 | 11/1988 | Wen-Shown | 36/127 |

OTHER PUBLICATIONS

Medicine and Science in Sports and Exercise, vol. 15, No. 3, pp. 247–255, 1983, "The Mechanics of Foot Action During the Golf Swing and Implications for Shoe Design".

*Primary Examiner*—James Kee Chi

*Attorney, Agent, or Firm*—Donald Brown; Robert T. Gammons

[57] ABSTRACT

This invention relates to shoesoles for the bottom of golf shoes and especially to shoesoles provided with, in addition to conventional spikes at the forepart and heel, ground-engaging protrusions distribution along the inner and outer marginal edges of the soles to enhance the stance of the golfer.

35 Claims, 3 Drawing Sheets

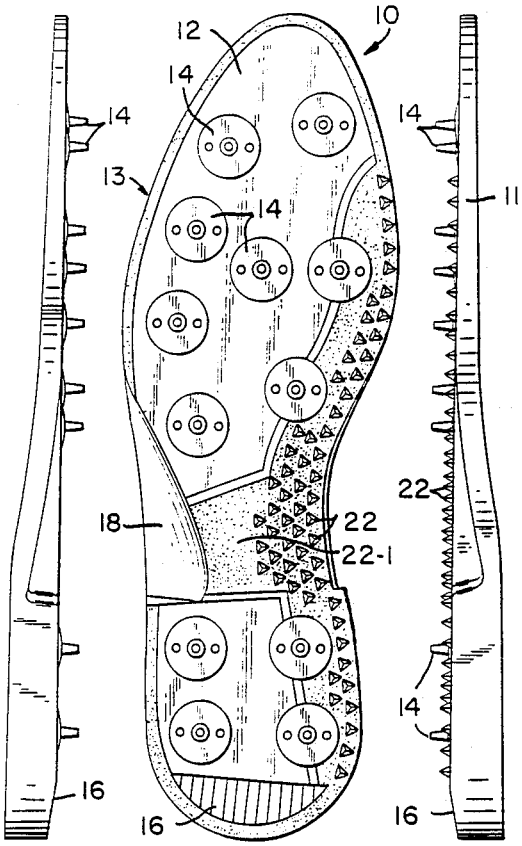
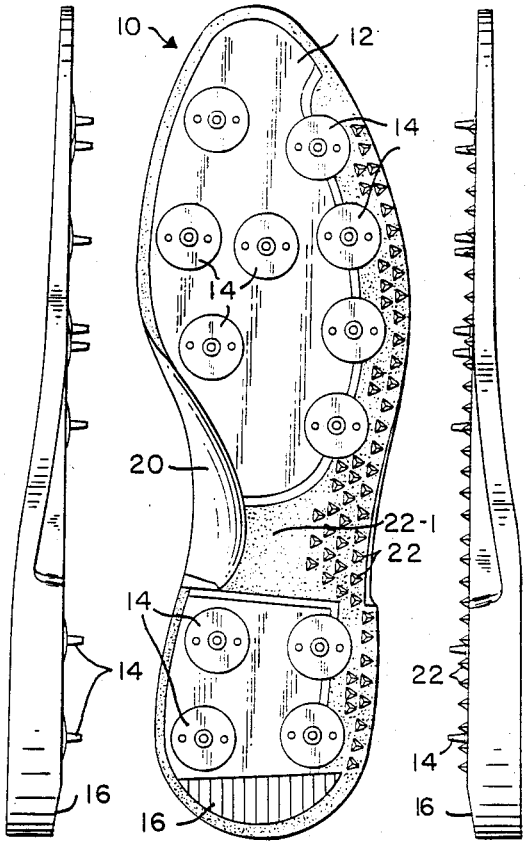
FIG.3 FIG.1 FIG.4 FIG.5 FIG.2 FIG.6

SHOESOLE FOR GOLF SHOE

BACKGROUND OF THE INVENTION

The conventional golf shoe has spikes or cleats secured to the sole distributed over the forepart and heel generally along opposite sides. Additional spikes or cleats may be provided between the opposite sides as, for example, midway between the opposite sides. The spikes provide ground-gripping means which prevent lateral shifting of the feet during the act of swinging the golf club and, hence, insure control. Many patents have been issued wherein the tread surface of the sole is provided with spikes or cleats or other ground-engaging means arranged in a pattern to provide for optimum stance. However, for the most part, such means have been concentrated at the heel and toe exclusively of the instep. It is significant that when the feet are placed firmly on the ground, the pressure is not wholly concentrated at the toe and heel but, rather, the maximum pressure is concentrated at the instep. Hence, it is desirable to make use of the pressure at the instep to enhance the ground-gripping action. The instant application has for its purpose to enhance ground-gripping by providing, in addition to the conventional spikes, supplemental friction-engendering means along the marginal edges of the sole at the inner and outer sides, respectively, of the right and left foot shoes of right-hand golfers and the outer and inner sides, respectively, of the left and right foot shoes of the left-hand golfers concentrated at the instep to take advantage of the pressure at the instep and, in particular, concentrated at the inner and outer sides of shoes for right-hand golfers and outer and inner sides of shoes for left-hand golfers. To further enhance the ground-gripping, the ground-engaging surfaces of the sole are substantially uniformly flat from heel to toe.

SUMMARY OF THE INVENTION

As herein illustrated, the invention resides in providing golf shoes with a concentration of traction-engendering means at the instep of the shoe, in addition to conventional spikes. For right-hand golfers, the concentration is provided at the inner side of the right shoe and the outer side of the left shoe. For left-hand golfers, the concentration is provided at the outer side of the right shoe and the inner side of the left shoe. As illustrated, the concentration takes the form of several transversely-disposed rows of protrusions in the area of the instep starting at the outer edge edge and extending inwardly to approximately the longitudinal center line. The rows of protrusions generally follow the contour of the edge along which they are distributed. Desirably, the rows most closely adjacent the edge extend rearwardly beyond the breastline of the heel to approximately the heel end and forwardly beyond the instep to approximately the toe. The protrusions are formed integral with the bottom and, desirably, are of triangular cross section.

The sole comprising the bottom is longitudinally wedge-shaped and has a uniformly flat, ground-engaging surface, that is, the heel, instep and forepart lie in a common plane, such that the protrusions which are of uniform height provide for substantially equal traction throughout the area of their distribution. The soles are comprised of a yieldable, elastomeric material molded to the desired configuration both as to peripheral configuration and as to thickness. The ground-engaging protrusions are molded in to the ground-engaging surface and threaded metal inserts are molded into the bottom for receiving conventional metal cleats. Desirably, and for the purpose of providing flexibility and comfort, the inwardly-facing surface of the sole is recessed throughout the forepart, shank and heel. Lattice in the form of ribs in the forepart, shank and heel provide for firm support while providing flexibility and light weight.

The invention will now be described in greater detail with reference to the accompanying drawings, wherein:

FIG. 1 is a plan view of the tread surface of the right shoe of a pair of shoes for a right-hand golfer;

FIG. 2 is a plan view of the tread surface of the left shoe of a pair of shoes for a right-hand golfer;

FIG. 3 is a side elevation of the left side of the right shoe shown in FIG. 1;

FIG. 4 is a side elevation of the right side of the right shoe shown in FIG. 1;

FIG. 5 is a side elevation of the left side of the left shoe shown in FIG. 2;

FIG. 6 is a side elevation of the right side of the left shoe shown in FIG. 2;

Figures 7, 8, 9, 10, 11, 12:
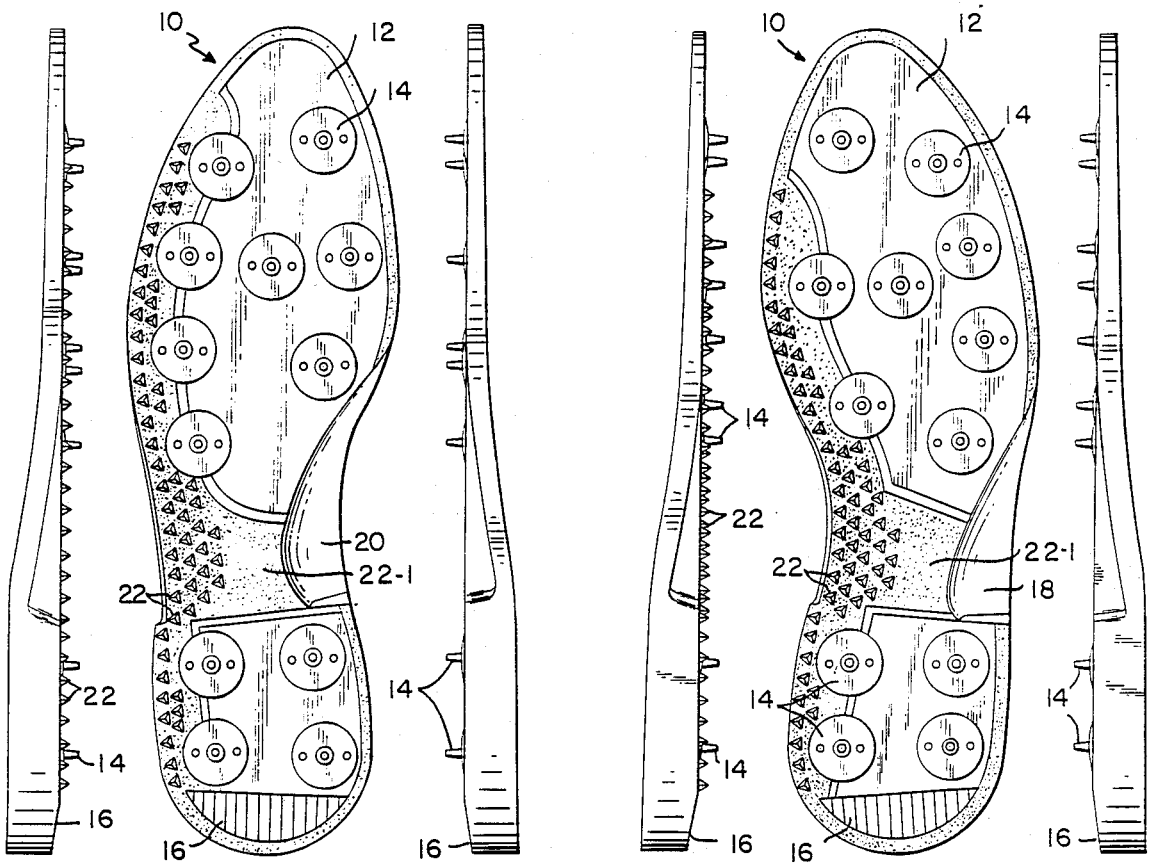
FIG. 7 is a plan view of the tread surface of the right shoe of a pair of golf shoes for left-hand golfers.
FIG. 8 is a plan view of the tread surface of the left shoe of a pair of golf shoes for left-hand golfers.
FIG. 9 is a side elevation of the left side of the right shoe shown in FIG. 7.
FIG. 10 is a side elevation of the right side of the right shoe shown in FIG. 7.
FIG. 11 is a side elevation of the left side of the left shoe shown in FIG. 8.
FIG. 12 is a side elevation of the right side of the left shoe shown in FIG. 8.

Referring to the drawings, FIGS. 1 and 2, there is shown in plan view the bottom of a right-foot golf shoe, FIG. 1, and the bottom of a left-foot golf shoe, FIG. 2, for right-hand golfers. As illustrated in these figures, the bottom indicated generally by the reference character 10 has a flat, ground-engaging surface 12 to which there are secured conventional metal spikes 14. The spikes 14 are distributed along the inner and outer sides of the forepart and along the inner and outer sides of the heel in generally parallel relation to the edge of the bottom. At approximately the center of the forepart, there is at least one additional spike 14. The disposition of the spikes as thus shown is conventional.

Figure 13:
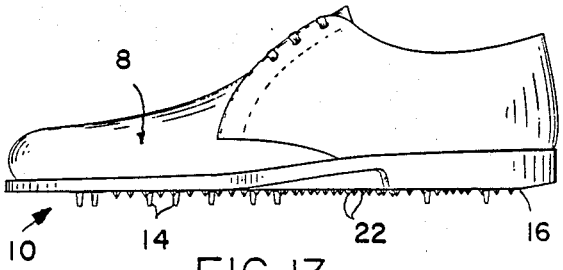
FIG. 13 is an elevation of the left side of the right shoe of a golf shoe for right-hand golfer.
Figure 17:
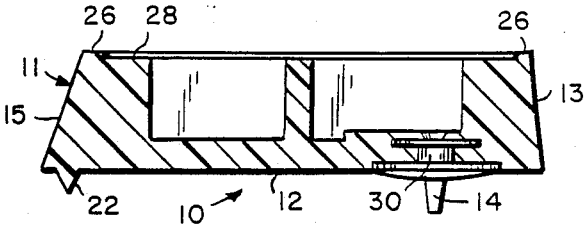
FIG. 17 is a section taken on the line 17—17 of FIG. 15.
Figure 18:
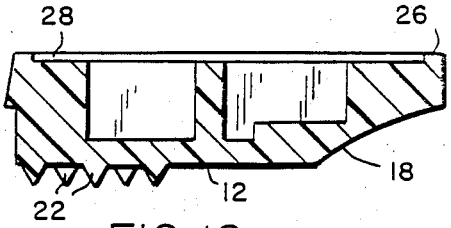
FIG. 18 is a section taken on the line 18—18 of FIG. 15.

The bottom 10, FIG. 13, is longitudinally wedge-shaped, as shown in side elevation, and the ground-engaging surface 12 to which the spikes 14 are fastened is generally planar. The peripheral face 11 of the heel at the outer side 13, FIG. 17, is generally perpendicular to the ground-engaging surface 12 and at the inner side 15 is inclined from the ground-engaging surface inwardly. The ground-engaging surface 12 at the heel end has an upwardly-inclined surface 16, FIG. 13. At the instep, FIG. 18, there is a recess 18 in the outer side of the right foot bottom member. There is a corresponding recess, not shown, in the inner side of the left foot bottom member.

In accordance with the invention, the shoe of the right-hand golfer, FIGS. 1 to 6, are provided with supplementary ground-engaging elements 22 formed on the ground-engaging surface 12. The ground-engaging elements are in the form of protrusions and preferably of triangular pyramidal configuration. The protrusions 22 on the bottom of the right foot shoe are distributed along the inner side thereof and the protrusions on the bottom of the left foot shoe are distributed along the outer side of the left foot shoe. The reason for such distribution on the inner side of the right foot and outer side of the left foot is that a right-hand golfer tends to shift his weight from right to left as he swings the club from right to left to thus cause penetration of the protrusions, the effect of which is to inhibit slipping.

In further accordance with the invention, the shoes of left-hand golfers, FIGS. 7 to 12, are provided with ground-engaging protrusions 22 on the bottom of the right foot along the outer side, FIG. 7, and the protrusions 22 on the bottom of the left shoe are distributed along the inner side, FIG. 8. The reason for such distribution on the inner side of the right foot shoe and the outer side of the left foot shoe is that the left-hand golfer tends to shift his weight from left to right as he swings his club from left to right to thus cause penetration of the protrusions, the effect of which is to inhibit slipping.

Figure 14:
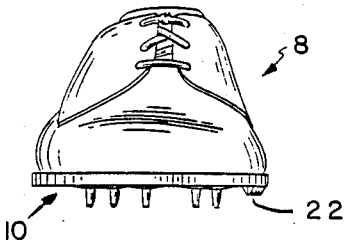
FIG. 14 is a front elevation of FIG. 13.
Figure 19:
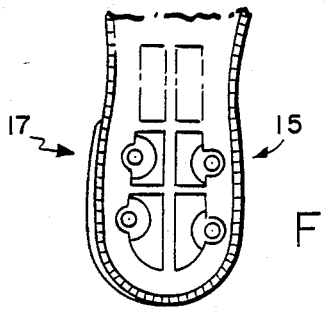
FIG. 19 is a fragmentary plan view of the inner side of the bottom of a left foot golf shoe made according to the invention.
Figure 16:
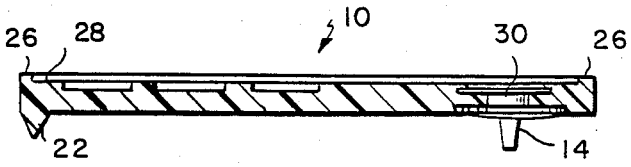
FIG. 16 is a section taken on the line 16—16 of FIG. 15.

FIGS. 13 and 14 show in elevation a golf shoe for the right foot of a right-handed golfer comprising an upper 8 to which there is attached an outsole 10 of wedge shape, that is, an outsole which tapers in thickness from the heel end toward the toe to the ground-engaging surface of which are removably attached golf spikes 14 and along the inner side of which are integrally formed protrusions 22 distributed therealong as shown in FIG. 1. The left shoe for the right-hand golfer would correspond to FIG. 13 with the difference that the protrusions 22 would be distributed along the outer side. The right and left shoes for a left-hand golfer, FIGS. 19 and 20, would have the protrusions along the right side of the right shoe, FIG. 7, and along the right side of the left shoe, FIG. 8.

It is to be observed that in all instances the protrusions are located exclusively at one side of the longitudinal center line of the bottom, that is, a line drawn from the tip of the toe to the back line of the heel.

It is to be observed that in each instance, the shoesoles for the right or left-hand golfer are longitudinally wedge-shaped, FIGS. 2, 7, 9 and 11, and the ground-engaging surfaces 12 are uniformly flat from the toe to near the rear end of the heel, the latter being provided rearwardly of the last of the spikes with a slightly upwardly-inclined surface 16 of lenticular configuration. Transversely, the bottom is of uniform thickness, FIGS. 14 and 15.

Figure 15:
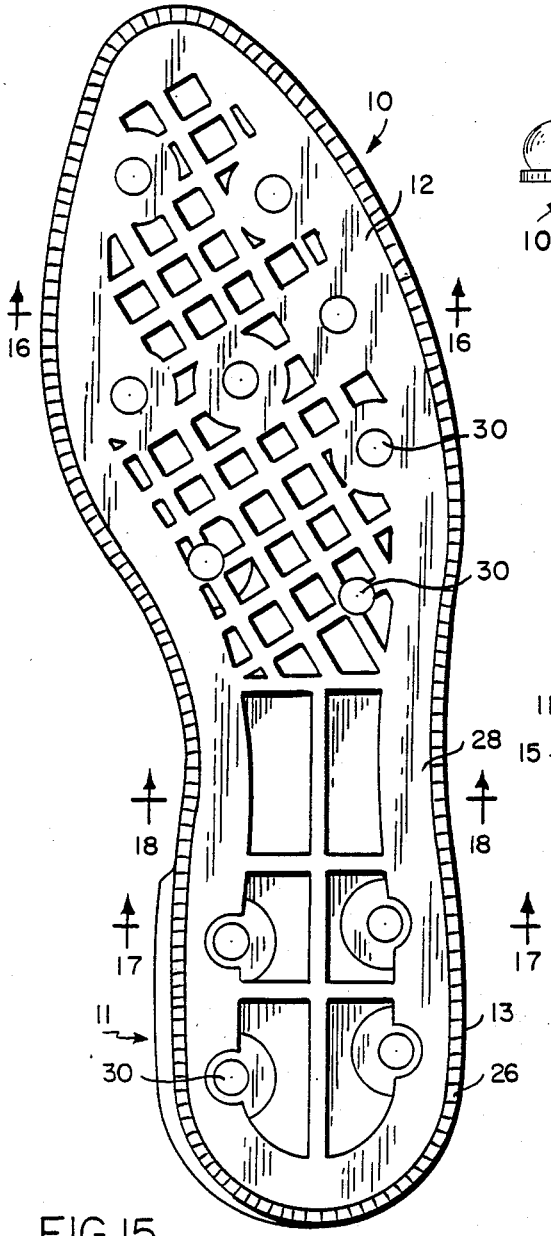
FIG. 15 is a plan view of the inner side of the bottom of a right foot golf shoe made according to this invention.

The inner side of the sole for shoes for both left and right-hand golf shoes, FIGS. 13, 14 and 15, has peripherally thereof a narrow marginal edge 26 which is knurled and inwardly thereof a marginal seating surface 28 for receiving the upper of the shoe. Inwardly of the marginal seating surface 28, the inner side is recessed at the forepart, shank and heel to reduce the overall weight.

In the manufacture of the soles, threaded socket members 30 are molded into the bottom structure for receiving the metal spikes 32.

It should be understood that the present disclosure is for the purpose of illustration only and includes all modifications or improvements which fall within the scope of the appended claims.

Other shaped protrusions in the forms of cones and cyclinders may also be used in the practice of this invention in place of the triangularly shaped protrusions 22 so long as they provide good release from the earth.

In this invention there is thus provided a full contact shank region 22-1 (see FIGS. 1, 2, 7 and 8) so that full contact by the entire bottom outsole except for the shank relief 20 is made in use by a golfer playing the game.

It is preferred that inner side 15 is inclined about 12.5 degrees to about 17.5 degrees from vertical with about 15 degrees of incline being most preferred.

What is claimed is:

1. A golf shoe comprising an upper and bottom, said bottom embodying a heel end portion, an instep portion and a toe portion defining a tread surface, spikes attached to the tread surface of the bottom at the toe portion and heel end portion and a plurality of protrusions formed integral with the tread surface of the bottom and disposed adjacent an edge thereof at the forwarding-facing sides of the golf shoe for right and left-hand golfers, comprising a single line of protrusions at said edge extending from the toe portion to the heel end portion and a plurality of protrusions at said instep portion.

2. A pair of golf shoes, each comprising an upper, an outsole comprising a toe portion, instep and heel end defining a tread surface, spikes attached to the tread surface at the toe portion and heel end portion and a plurality of protrusions formed integral with the tread surface of the outsole along an inner side of the right shoe and along an outer side of the left shoe comprising a single line of protrusions along said sides extending from forepart to heel end and a plurality of protrusions at the instep.

3. A pair of golf shoes, each comprising an upper, an outsole comprising a forepart, instep and heel end defining a tread surface, spikes attached to the tread surface at the forepart and heel end and a plurality of protrusions formed integral with the tread surface of the outsole along an inner side of a left shoe and along an outer side of a right shoe comprising a single line of protrusions at said sides extending from forepart to heel end and a plurality of protrusions at the instep.

4. A pair of shoesoles for a right-hand golfer, said shoesoles comprising right and left shoesoles, each shoesole comprising a heel end portion, an instep portion and a toe end portion and each shoesole comprising inner and outer sides and a ground-engaging surface, said shoesoles having on their ground-engaging surfaces conventionally-distributed spikes, said right shoesole having marginally of its inner side exclusively of its outer side and said left shoesole having marginally of its outer side exclusively of its inner side a plurality of ground engaging protrusions distributed along said surface in longitudinally-spaced relation and extending from near the heel end portion to near the toe end portion.

5. A shoesole according to claim 4 wherein the shoesole is longitudinally wedge-shaped.

6. A shoesole according to claim 4 wherein the ground-engaging surfaces is provided with threaded sockets for receiving spikes so positioned that they are located laterally of the protrusions.

7. A shoesole according to claim 4 wherein the ground-engaging surface transversely of the heel end portion is inclined.

8. A shoesole according to claim 4 wherein the ground-engaging surface of the shoesole is recessed inwardly of the outer and inner sides.

9. A shoesole according to claim 8 wherein the recess is structurally reinforced with ribs.

10. A pair of shoesoles for left-hand golfers, said shoesoles comprising right and left shoesoles, each shoesole comprising a heel end portion, an instep portion and a toe end portion and each shoesole comprising inner and outer sides and a ground-engaging surface, said shoesoles having on their ground-engaging surfaces conventionally distributed spikes, said right shoesole having marginally of its outer side exclusively of its inner side and said left shoesole having marginally of its inner side exclusively of its outer side a plurality of ground-engaging protrusions distributed along said surface in longitudinally-spaced relation and extending from near the heel end portion to near the toe end portion.

11. A shoesole according to claim 10 wherein the shoesole is longitudinally wedge-shaped.

12. A shoesole according to claim 10 wherein the ground-engaging surface is provided with threaded sockets for receiving spikes so positioned that they are located laterally of the protrusions.

13. A shoesole according to claim 10 wherein the ground-engaging surface transversely of the heel end portion is inclined.

14. A shoesale according to claim 10 wherein the ground-engaging surface of the shoesole is recessed inwardly of the outer and inner sides.

15. A shoesale according to claim 14 wherein the recess is structurally reinforced with ribs.

16. A shoesale for the right shoe of a right-hand golfer, comprising a heel end portion, an instep portion and a toe portion and said shoesole further comprising inner and outer sides and a uniformly-flat, ground-engaging surface throughout the major portion of its length and width and said shoesole having on its ground-engaging surface conventionally distributed spikes characterized in that there is a multiplicity of ground-engaging protrusions formed integral with the ground-engaging surface of the shoesole adjacent the inner side with at least a single line of protrusions extending longitudinally of the shoesole along the inner side from the heel end portion to the toe end portion exclusively of the outer side and a multiplicity of transversely-spaced lines of ground-engaging protrusions at the instep portion adjacent and parallel to said single line of protrusions and wherein the protrusions in the lines of protrusions are longitudinally-spaced and the protrusions in the adjacent lines of protrusions are offset relative to each other half the distance between protrusions in the lines of protrusions.

17. A shoesole according to claim 16 wherein the right foot shoesole contains in the ground-engaging surface a recess at the outer side extending from a breastline of the heel end portion forwardly toward the toe portion.

18. A shoesole according to claim 16 wherein a peripheral edge face of the shoesole at the inner side of the right foot shoesole is inclined from the ground-engaging surface inwardly.

19. A shoesole according to claim 16 comprising a recess in the area of the instep portion extending from the outer side transversely but short of an imaginary longitudinal center line extending from a tip of the toe portion to a back of the heel end portion.

20. A shoesole according to claim 16 wherein the rows of protrusions at the instep portion do not extend beyond a longitudinal center line of the shoesole.

21. A shoesole for the left shoe of a right-hand golfer, comprising a heel end portion, an instep portion and a toe portion and said shoesole further comprising inner and outer sides and a uniformly-flat, ground-engaging surface throughout the major portion of its length and width and said shoesole having on its ground-engaging surface conventionally-distributed spikes, characterized in that there is a multiplicity of ground-engaging protrusions formed integral with the ground-engaging surface of the shoesole at the outer side with at least a single row of protrusions extending longitudinally of the shoesole along the outer side from the heel end portion to the toe end portion, exclusively of the inner side and a multiplicity of transversely-spaced lines of ground-engaging protrusions at the instep portion adjacent and parallel to said single line of protrusions and wherein the protrusions in the lines of protrusions are longitudinally-spaced and the protrusions in the adjacent lines of protrusions are offset relative to each other half the distance between the protrusions in the lines of protrusions.

22. A shoesole according to claim 21 wherein the left foot shoesole contains in the ground-engaging surface a recess at the inner side extending from a breastline of the heel end portion forwardly toward the toe portion.

23. A shoesole according to claim 21 wherein a peripheral edge face of the shoesole at the outer side of the right foot shoesole is generally perpendicular to the ground-engaging surface.

24. A shoesole according to claim 32 comprising a recess in the area of the instep portion extending from the inner side transversely but short of an imaginary longitudinal center line extending from a tip of the toe portion to a back of the heel end portion.

25. A shoesole according to claim 21 wherein the rows of protrusions at the instep portion do not extend beyond a longitudinal center line of the shoesole.

26. A shoesole for the right shoe of a left-hand golfer, comprising a heel end portion, an instep portion and a toe portion and said shoesole further comprising inner and outer sides and a uniformly-flat, ground-engaging surface throughout the major portion of its length and width and said shoesole having on its ground-engaging surface conventionally-distributed spikes, characterized in that there are a multiplicity of ground-engaging protrusions formed integral with the ground-engaging surface of the shoesole at its outer side with at least a single line of protrusions extending longitudinally of the shoesole along the outer side from the heel end portion to the toe end portion exclusively of the inner side and a multiplicity of transversely-spaced lines of ground-engaging protrusions at the instep portion adjacent and parallel to said line of said single line of protrusions and wherein the protrusions in the lines of protrusions are longitudinally-spaced and the protrusions in the adjacent lines of protrusions are offset relative to each other half the distance between protrusions in the lines of protrusions.

27. A shoesole according to claim 26 wherein the right foot shoesole contains in the ground-engaging surface a recess at the inner side extending from a breastline of the heel end portion forwardly toward the toe portion.

28. A shoesole according to claim 26 wherein a peripheral edge face of the shoesole at the outer side of the left foot shoesole is inclined from the ground-engaging surface inwardly.

29. A shoesole according to claim 26 comprising a recess in the area of the instep portion extending from the outer side transversely but short of an imaginary longitudinal center line extending from a tip of the toe portion to a back of the heel end portion.

30. A shoesole according to claim 26 wherein the rows of protrusions at the instep portion do not extend beyond a longitudinal center line of the shoesole.

31. A shoesole for the left shoe of a left-hand golfer, comprising a heel end portion, an instep portion and a toe portion and said shoesole further comprising inner and outer sides and a ground-engaging surface throughout the major portions of its length and width and said shoesole having on its ground-engaging surface conventionally-distributed spikes, characterized in that there are a multiplicity of ground-engaging protrusions formed integral with the ground-engaging surface of the shoesole at the outer side with at least a single line of protrusions extending longitudinally of the shoesole along the outer side from the heel end portion to the toe portion, exclusively of the inner side and a multiplicity of transversely-spaced lines of ground-engaging protrusions at the instep portion adjacent and parallel to said single line of protrusions and wherein the protrusions in the lines of protrusions are longitudinally-spaced and the protrusions in the adjacent lines of protrusions are offset relative to each other half the distance between the protrusions in the lines of protrusions.

32. A shoesole according to claim 31 wherein the left foot shoesole contains in the ground-engaging surface a recess at the outer side extending from a breastline of the heel end portion forwardly toward the toe portion.

33. A shoesole according to claim 31 wherein a peripheral edge face of the shoesole at the inner side of the left foot shoesole is generally perpendicular to the ground-engaging surface.

34. A shoesole according to claim 31 comprising a recess in the area of the instep portion extending from the inner side transversely but short of an imaginary center line extending from a tip of the toe portion to a back of the heel end portion.

35. A shoesole according to claim 31 comprising a recess extending from the sides transversely but short of a longitudinal center line.

* * * * *